US010663996B2

(12) United States Patent
Matsuda et al.

(10) Patent No.: US 10,663,996 B2
(45) Date of Patent: May 26, 2020

(54) CONSTANT CURRENT CIRCUIT

(71) Applicant: ABLIC Inc., Chiba-shi, Chiba (JP)

(72) Inventors: Takashi Matsuda, Chiba (JP); Fumihiko Maetani, Chiba (JP)

(73) Assignee: ABLIC INC., Chiba (JP)

( * ) Notice: Subject to any disclaimer, the term of this patent is extended or adjusted under 35 U.S.C. 154(b) by 0 days.

(21) Appl. No.: 16/540,659

(22) Filed: Aug. 14, 2019

(65) Prior Publication Data

US 2020/0073422 A1 Mar. 5, 2020

(30) Foreign Application Priority Data

Aug. 31, 2018 (JP) ..... 2018-162908

(51) Int. Cl.

| | |
|---|---|
| ***G05F 1/10*** | (2006.01) |
| ***G05F 3/02*** | (2006.01) |
| ***G05F 3/24*** | (2006.01) |
| ***G05F 1/56*** | (2006.01) |

(52) U.S. Cl.
CPC ..... *G05F 1/56* (2013.01)

(58) Field of Classification Search
CPC ..... G05F 1/56
See application file for complete search history.

(56) References Cited

U.S. PATENT DOCUMENTS

| | | | | |
|---|---|---|---|---|
| 4,760,284 | A * | 7/1988 | Taylor | G05F 3/22 327/541 |
| 5,422,563 | A * | 6/1995 | Pflueger | G05F 1/575 323/312 |
| 7,808,308 | B2 * | 10/2010 | Lai | G05F 3/30 327/538 |
| 8,212,545 | B2 * | 7/2012 | Imura | G05F 3/24 323/313 |
| 10,401,891 | B2 * | 9/2019 | Sakaguchi | G05F 3/262 |
| 2005/0174165 | A1 | 8/2005 | Shimada | |

FOREIGN PATENT DOCUMENTS

JP 2005-222301 A 8/2005

* cited by examiner

*Primary Examiner* — Kenneth B Wells
(74) *Attorney, Agent, or Firm* — Brinks Gilson & Lione

(57) ABSTRACT

There is provided a constant current circuit having a current characteristic satisfactory in a high voltage circuit while being low in manufacturing cost. The constant current circuit includes a high breakdown-voltage depletion type NMOS transistor and a low breakdown-voltage depletion type NMOS transistor connected in series between a first terminal and a second terminal. The low breakdown-voltage depletion type NMOS transistor includes a first depletion type NMOS transistor and a second depletion type NMOS transistor connected in series. The high breakdown-voltage depletion type NMOS transistor has a gate connected to a connecting point of the first depletion type NMOS transistor and the second depletion type NMOS transistor.

3 Claims, 3 Drawing Sheets

RELATED ART

CONSTANT CURRENT CIRCUIT

RELATED APPLICATIONS

Priority is claimed on Japanese Patent Application No. 2018-162908, filed on Aug. 31, 2018, the content of which is incorporated herein by reference.

BACKGROUND OF THE INVENTION

1. Field of the Invention

The present invention relates to a constant current circuit.

2. Description of the Related Art

There is a constant current circuit having a current characteristic satisfactory even in a high voltage circuit. A constant current circuit 300 as a related art is illustrated in FIG. 3. The constant current circuit 300 consists of a low breakdown-voltage depletion type NMOS transistor 30 and a high breakdown-voltage depletion type NMOS transistor 31.

The NMOS transistor 30 has a source and a gate which are respectively connected to a terminal N2 and a drain connected to a source of the NMOS transistor 31. The NMOS transistor 31 has the source, a drain connected to a terminal N1 and a gate connected to the terminal N2 and the gate of the NMOS transistor 30.

Since a drain-source voltage of the NMOS transistor 30 is limited to an absolute value or less of a threshold voltage of the NMOS transistor 31, the constant current circuit 300 is capable of reducing a variation in current due to a channel-length modulation effect of the NMOS transistor 30 and obtaining a stable constant current (refer to, e.g., Japanese Patent Application Laid-Open No. 2005-222301).

SUMMARY OF THE INVENTION

In the constant current circuit 300, however, the low breakdown-voltage NMOS transistor 30 and the high breakdown-voltage NMOS transistor 31 are configured that the absolute value of the threshold voltage of the high breakdown-voltage NMOS transistor 31 is larger than an absolute value of a threshold voltage of the low breakdown-voltage NMOS transistor 30 for the purpose of operating as a constant current circuit. That is, in the case where since there is a restriction on the threshold voltage of the high breakdown-voltage NMOS transistor 31, it is different in threshold voltage from a similar high breakdown-voltage NMOS transistor, a process of providing high breakdown-voltage NMOS transistors different in threshold voltage is required. Thus, the constant current circuit 300 takes high manufacturing cost.

An object of the present invention is to provide a constant current circuit having a current characteristic satisfactory in a high voltage circuit while being low in manufacturing cost.

According to one aspect of the present invention, there is provided a constant current circuit which includes a high breakdown-voltage depletion type NMOS transistor having a drain connected to a first terminal and a source, and a low breakdown-voltage depletion type NMOS transistor having a drain connected to the source of the high breakdown-voltage depletion type NMOS transistor and a source connected to a second terminal, the low breakdown-voltage depletion type NMOS transistor including a first depletion type NMOS transistor and a second depletion type NMOS transistor connected in series, the high breakdown-voltage depletion type NMOS transistor further having a gate connected to a connecting point of the first depletion type NMOS transistor and the second depletion type NMOS transistor.

In a constant current circuit of the present invention, a gate voltage of a high breakdown-voltage depletion type NMOS transistor can be made high by connecting a gate of the high breakdown-voltage depletion type NMOS transistor to a connecting point of a low breakdown-voltage first depletion type NMOS transistor and a low breakdown-voltage second depletion type NMOS transistor. The constant current circuit is therefore capable of greatly decreasing restrictive conditions related to a threshold voltage of the high breakdown-voltage depletion type NMOS transistor for allowing the low breakdown-voltage depletion type NMOS transistor to operate in saturation and reducing its manufacturing cost.

DETAILED DESCRIPTION OF THE PREFERRED EMBODIMENTS

Preferred embodiments of the present invention will hereinafter be described with reference to the accompanying drawings.

Figure 1:
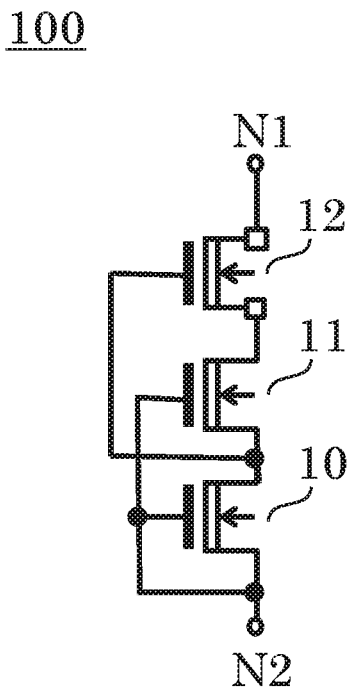
FIG. 1 is a circuit diagram illustrating an example of a constant current circuit according to an embodiment of the present invention.

FIG. 1 is a circuit diagram illustrating a constant current circuit 100, wherein the constant current circuit 100 is an example of a constant current circuit according to an embodiment of the present invention. The constant current circuit 100 includes depletion type NMOS transistors 10 and 11 serving as a low breakdown-voltage depletion type NMOS transistor, and a high breakdown-voltage depletion type NMOS transistor 12.

The NMOS transistor 10 has a source and a gate which are respectively connected to a terminal N2 and a drain connected to a source of the NMOS transistor 11. The NMOS transistor 11 has a gate connected to the terminal N2 and a drain connected to a source of the NMOS transistor 12. Each of the NMOS transistors 10 and 11 is low breakdown-voltage depletion type NMOS transistor and has a lower breakdown-voltage than a breakdown-voltage of the NMOS transistor 12. The NMOS transistor 12 has a drain connected to a terminal N1 and a gate connected to the drain of the NMOS transistor 10 and the source of the NMOS transistor 11. That is, the gate of the NMOS transistor 12 is connected to a connecting point of the NMOS transistors 10 and 11. As described above, in the constant current circuit 100, the low breakdown-voltage depletion type NMOS transistor contains the NMOS transistors 10 and 11, and is configured by the NMOS transistors 10 and 11 which are connected in series.

The constant current circuit 100 is configured to satisfy an equation (1) in order to allow the NMOS transistor 11 to operate in saturation. The equation (1) is expressed by $$VD11-VN2>VG11-VN2-VTH10_11 \quad (1),$$

wherein VD11 is a drain voltage of the NMOS transistor 11, VN2 is a voltage of the terminal N2, VG11 is a gate voltage of the NMOS transistor 11, and VTH10_11 is a threshold voltage in a case where the NMOS transistor 10 and the NMOS transistor 11 are considered to be one NMOS transistor.

Further, the drain voltage VD11 of the NMOS transistor 11 can be represented by a following equation $$VD11-VN2=VG12-VN2-VTH12 \quad (2),$$

wherein VG12 is a gate voltage of the NMOS transistor 12 and VTH12 is a threshold voltage of the NMOS transistor 12.

Since the gate of the NMOS transistor 11 is connected to the terminal N2, an equation (3) is obtained from the equation (1) and the equation (2), and expressed by $$VG12-VN2>VTH12-VTH10_11 \quad (3).$$

The constant current circuit 100 is configured to take the gate voltage VG12 of the NMOS transistor 12 from the drain of the NMOS transistor 10 and is therefore capable of satisfying the equation (3) even if, for example, the threshold voltage VTH12 is higher than the threshold voltage VTH10_11. As a result of satisfying the equation (3), the constant current circuit 100 enables the NMOS transistor 11 to operate in saturation because the equation (1) is satisfied.

As described above, the low breakdown-voltage depletion type NMOS transistor in the constant current circuit 100 is divided into the NMOS transistors 10 and 11. Further, the constant current circuit 100 is configured to take the gate voltage of the high breakdown-voltage NMOS transistor 12 from a connecting point of the two NMOS transistors 10 and 11. The constant current circuit 100 including the above-mentioned configuration is capable of adjusting the gate voltage of the high breakdown-voltage NMOS transistor 12 by adjusting the voltage of the drain of the NMOS transistor 10, and is thereby capable of satisfying the restrictive conditions related to the threshold voltage of the NMOS transistor 12 for allowing the NMOS transistor 11 to operate in saturation without the process of providing high breakdown-voltage NMOS transistors different in threshold voltage. The constant current circuit 100 needs greatly less restrictive conditions related to the threshold voltage of the NMOS transistor 12 for allowing the NMOS transistor 11 to operate in saturation than the constant current circuit configured by a single depletion type NMOS transistor, such as the conventional current circuit 300. Further, the constant current circuit 100 does not need the process of providing high breakdown-voltage NMOS transistors different in threshold voltage, and therefore manufacturing cost of the constant current circuit 100 can be reduced.

Incidentally, there may be a case where the saturation operation of the NMOS transistor 11 is severe from the relation between the threshold voltage VTH12 and the threshold voltage VTH10_11. In this case, the number of divisions of the low breakdown-voltage NMOS transistor may be increased to take the gate voltage of the NMOS transistor 12 from a higher voltage. Further, in terms of an L length of the low breakdown-voltage NMOS transistor, the length ratio of the NMOS transistor 10 to the NMOS transistor 11 may be increased.

Figure 2:
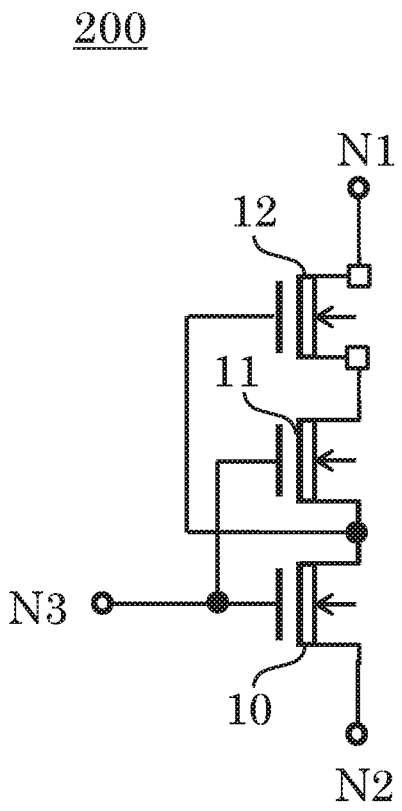
FIG. 2 is a circuit diagram illustrating another example of the constant current circuit according to the embodiment.
Figure 3:
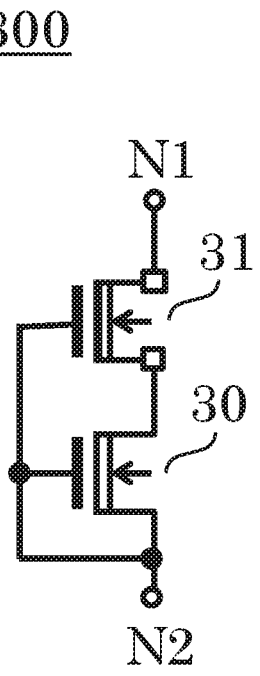
FIG. 3 is a circuit diagram illustrating a constant current circuit as a related art.

FIG. 2 is a circuit diagram illustrating the constant current circuit 200. The constant current circuit 200 is another example of the constant current circuit according to the present embodiment. The constant current circuit 200 is different from the constant current circuit 100 in that a gate of a low breakdown-voltage NMOS transistor is connected to a terminal N3 instead of the terminal N2. That is, in the constant current circuit 200, a voltage applied to the gate of the low breakdown-voltage NMOS transistor is different from that of a source of the low breakdown-voltage NMOS transistor.

In the constant current circuit 200, an equation (4) is yielded from the equation (1) and the equation (2), and expressed by $$VG12>VG11+VTH12-VTH10_11 \quad (4).$$

In this case, although the constant current circuit 200 becomes severe in condition in terms of only the voltage VG11 as compared with the constant current circuit 100, the constant current circuit 200 can cope with such a severe condition by taking the gate voltage of the NMOS transistor 12 from a higher voltage. That is, it is possible to cause the low breakdown-voltage NMOS transistor to operate in saturation without changing the threshold voltage of the high breakdown-voltage NMOS transistor.

Although the embodiments of the present invention have been described above, the present invention is not limited to the above embodiments. Various changes can be made thereto within the scope not departing from the gist of the present invention.

What is claimed is:

1. A constant current circuit comprising:

a high breakdown-voltage depletion type NMOS transistor having a drain connected to a first terminal and a source; and a low breakdown-voltage depletion type NMOS transistor having a drain connected to the source of the high breakdown-voltage depletion type NMOS transistor and a source connected to a second terminal, the low breakdown-voltage depletion type NMOS transistor including a first depletion type NMOS transistor and a second depletion type NMOS transistor connected in series, the high breakdown-voltage depletion type NMOS transistor further having a gate connected to a connecting point of the first depletion type NMOS transistor and the second depletion type NMOS transistor.

2. The constant current circuit according to claim 1, wherein the first depletion type NMOS transistor and the second depletion type NMOS transistor respectively have gates connected to the second terminal.

3. The constant current circuit according to claim 1, wherein the first depletion type NMOS transistor and the second depletion type NMOS transistor respectively have gates connected to a third terminal.

* * * * *